US005178452A

United States Patent [19]

Scholz

[11] Patent Number: 5,178,452

[45] Date of Patent: Jan. 12, 1993

[54] OPERATING THEATRE LAMP

[75] Inventor: Manfred Scholz, Seitingen, Fed. Rep. of Germany

[73] Assignee: Delma elektro-und medizinische Geraetebau Gesellschaft mbH, Tuttlingen, Fed. Rep. of Germany

[21] Appl. No.: 733,765

[22] Filed: Jul. 23, 1991

[30] Foreign Application Priority Data

Jul. 23, 1990 [DE] Fed. Rep. of Germany ..... 4023408

[51] Int. Cl.[5] ..... F21V 17/02

[52] U.S. Cl. ..... 362/319; 362/304; 362/346; 362/804

[58] Field of Search ..... 362/804, 147, 304, 306, 362/319, 346

[56] References Cited

U.S. PATENT DOCUMENTS

| | | | |
|---|---|---|---|
| 3,835,342 | 9/1974 | Freeman | 362/304 |
| 4,135,232 | 1/1979 | Berkenhoff | 362/306 |
| 4,422,135 | 12/1983 | McCamy | 362/304 |
| 4,617,619 | 10/1986 | Gehly | 362/804 |
| 4,622,625 | 11/1986 | Becker et al. | 362/804 |
| 4,729,065 | 3/1988 | Bahnemann et al. | 362/304 |
| 4,884,008 | 11/1989 | Bossler et al. | 362/804 |

*Primary Examiner*—Stephen F. Husar
*Attorney, Agent, or Firm*—Townsend & Townsend

[57] ABSTRACT

An operating theatre lamp with a main reflector (13) which illuminates the area of the operation (11) with a convergent main light beam (12) and an auxiliary reflector (15) can be arranged inside the main reflector to deflect a part of the used light beam (16) at a steeper angle to the site of the operation (11).

13 Claims, 1 Drawing Sheet

OPERATING THEATRE LAMP

Figure 2:
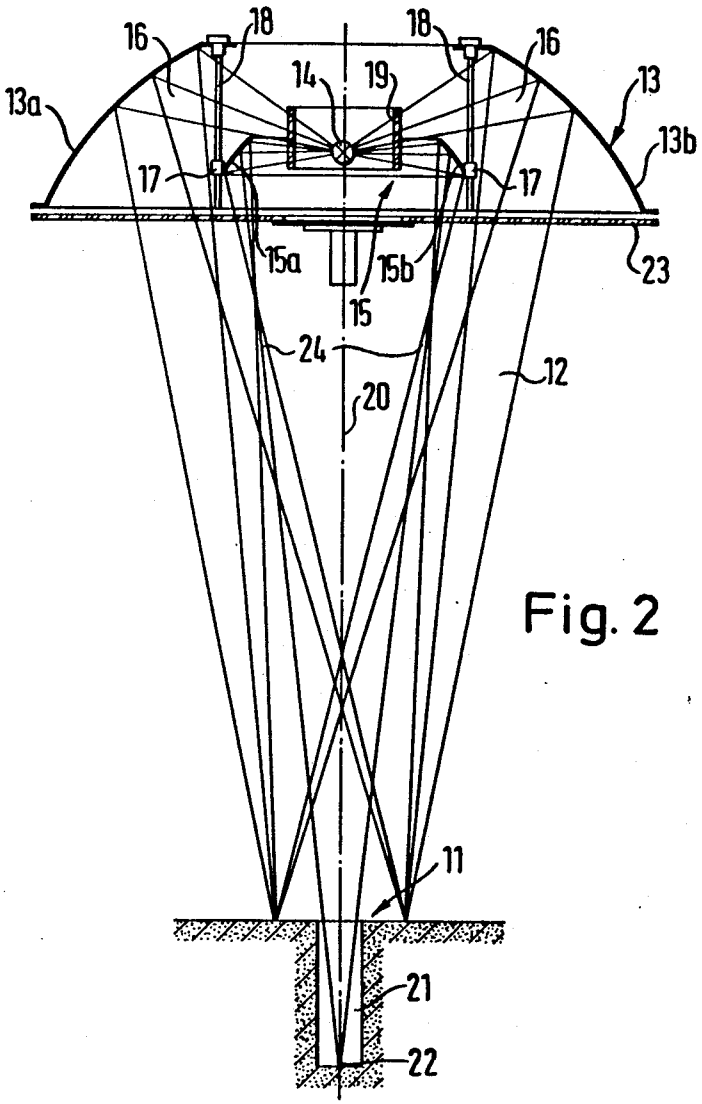

The invention relates to an operating theatre lamp comprising a main reflector which illuminates the site of the operation with a convergent main light beam, the main reflector having at least two diametrically oppositely disposed concave mirror main regions which deflect light transmitted from a light source arranged between them towards the site of the operation and concentrate it there. The light source can comprise one or more lamps or bulbs.

In a medical operation it is necessary to ideally illuminate the region of the operation. The illumination is to take place in such a way that despite manipulations effected by the surgeon and his assistants between the lamp and the area of the operation the formation of hard shadows is largely avoided. In order to achieve this various operating theatre lamp systems have become known in which the hard shadow formation is prevented by divergent and superimposed light from large reflectors, lens systems and also combinations of several individual reflectors. A ring reflector of concave mirror-like shape and with a comparatively large diameter can in particular be provided the light source located at its center. The light which emerges from the light source in all directions is first deflected as result of this arrangement towards the area of the operation at a comparatively large distance from the light source so that a strongly convergent cone-like light beam impinges on the area of the operation and there generates an illuminated area of defined extent. This illuminated area will be termed the site of the operation in the following because the surgical wound will be present at this site. In other words the light is deflected through the relevant reflector construction from above and from all sides onto the area of the operation in order to form an illuminating operation site there.

This arrangement of the light beam has however the disadvantage that for comparatively deep depressions in the body of the patient which extend more or less vertically downwardly the obliquely incident light no longer reaches the base of the recess or only just reaches the lowest position of the recess where a surgical procedure is to be effected, and thus no longer completely illuminates it.

The object of the invention is thus to provide an operating theatre lamp of the initially named kind with which, on the one hand, an illumination of the site of the operation is achieved which is largely free from hard shadows, such as is inherent in known operating theatre lamps, but with which, on the other hand, comparatively deep and narrow surgical wounds can also be simultaneously illuminated well without additional light sources being necessary for this purpose.

In order to satisfy this object the invention provides an operating theatre lamp of the initially named kind which is characterized in that at least one auxiliary reflector is provided and has at least two diametrically oppositely disposed concave mirror auxiliary regions which are disposed closer to the light source than the main regions, with the auxiliary reflector normally being disposed outside of the operational light beam leading to the main reflector, but being at least partially introducable into the operational light beam leading to the main reflector and in this state so reflecting and concentrating the incident light from the light source onto the auxiliary regions disposed on diametrically opposite sides of the light source that an auxiliary light beam impinges onto the site of the operation at a steeper angle than the main light beam.

In an advantageous further development of this inventive concept one or both of the part regions are of partly circular shape, with the axis of the circle coinciding with the main beam axis. Moreover, the partial regions are preferably concentric to one another and to the light source.

In a particularly preferred arrangement both partial regions of the main and auxiliary reflectors are combined into a unitary preferably circular or polygonal ring.

The concept underlying the invention is thus to introduce a further auxiliary reflector into an operating theatre lamp with a reflector ring of comparatively large diameter as known per se in such a way that one can switch over without loss of light from strongly convergent to weakly convergent light at the site of the operation and vice versa. In this way the surgeon can selectively obtain the correct light for each type of operation (for example for large area wounds in a plane and for narrow deep wounds). On introduction into the used light beam the auxiliary reflector, which can also be termed the deep light reflector, obstructs in particular that part of the main reflector which generates the light which is particularly strongly convergent towards the site of the operation. This effect is in particular obtained by an arrangement in which the auxiliary reflector can be inserted into the largest diameter area of the main reflector.

The smallest path of displacement for the auxiliary reflector is obtained by an embodiment which characterized in that the auxiliary reflector is located in its inactive position directly beneath the operational light beam which is incident on the main reflector and can be introduced from this position into the lower part of the operational light beam.

Particularly preferred is a coaxial relative displacement of the auxiliary and main reflectors, that is to say by an arrangement in which the auxiliary reflector is coaxially displaceable relative to the main reflector.

A practical realization for the adjustment of the auxiliary reflector relative to the main reflector is characterized by an arrangement in which nuts with axially threaded bores are secured to the auxiliary reflector, with threaded bars which are rotatably journalled relative to the main reflector engaging into the nuts.

A further optimization can be provided by an arrangement in which the auxiliary reflector is semi-permeable. In this way the light from all the areas of the main and auxiliary reflectors reach the site of the operation even if in partially attenuated form, which is nevertheless useful for the various surgical problems.

In a particularly preferred embodiment the centrally arranged light source is axially displaceably arranged. Through displacement of the light source the area of the field of light is variable and the spacing focussable.

Another particularly preferred embodiment is characterized in that the reflector surface of the main and/or auxiliary reflectors are formed by abutting individual ring surfaces of such a curvature in a vertical sectional plane that each of these individual ring surfaces illuminates the entire site of the operation. With this embodiment one can obtain a particularly effective superposition of a plurality of light beams at the site of the operation.

Figure 1:
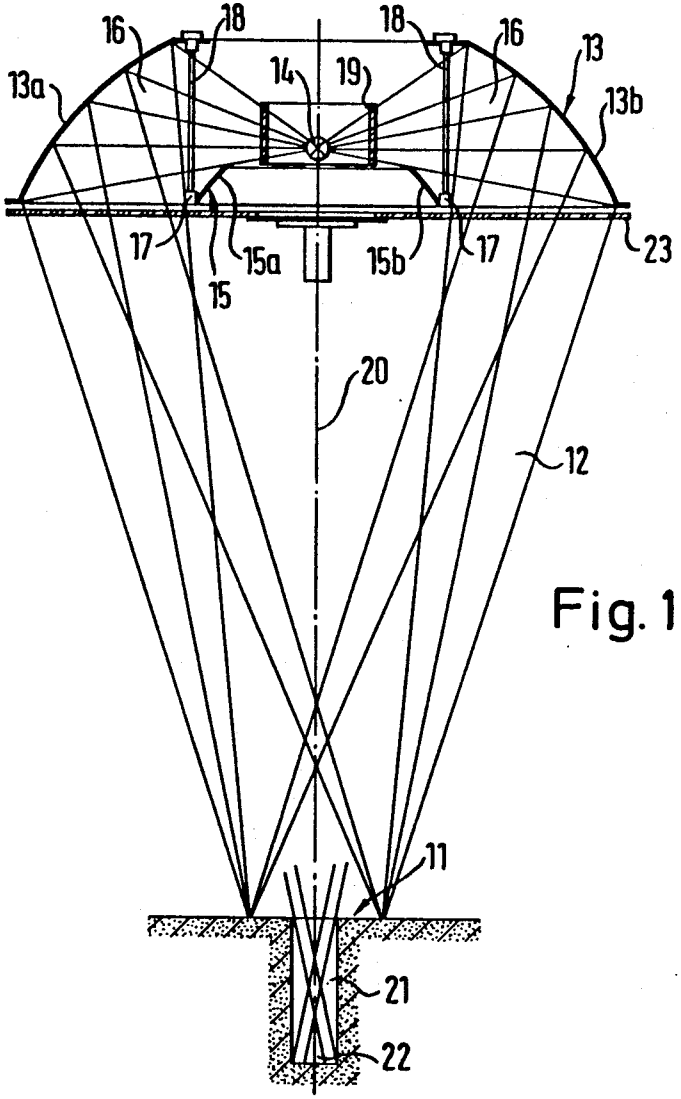

The invention will now be described in the following by way of example and with reference to the drawings in which are shown:

FIG. 1: a schematic sectioned sideview of an operating theatre lamp in accordance with the invention, with the auxiliary reflector located in the inactive position, and FIG. 2: a corresponding view of the same operating theatre lamp with the auxiliary reflector in its active position.

As seen in FIG. 1 a light source 14 is arranged at the center of an operating theatre lamp and transmits the light which emerges from it in the shape of an annular divergent operational light beam 16. Concentric to the light source 14 and to the main beam direction 20 of the lamp there is provided a circular cylindrical filter 19 which is intended to keep back ultraviolet and in particular infrared radiation so that the site of the operation 11 is not heated too strongly. The filter 19 can also be so executed that it converts ultraviolet radiation to visible light.

Two diametrically oppositely disposed concave mirror main regions 13*a*, 13*b* are arranged with a substantially larger radial spacing from the light source 14 than the filter 19. They extend circularly around the axis 20 and are combined into a unitary circular ring-shaped main reflector 13. The main reflector 13 can be composed of several concentric individual ring reflectors of different diameter which are for example put together in polygonal manner, with each individual ring reflector having a curvature (in the vertical section plane of FIG. 1) such that each of these individual ring reflectors illuminates the entire site 11 of the operation, as is illustrated in FIG. 1 by means of five rays. The differential curvature of the individual ring reflectors is not shown in FIGS. 1 and 2 for reasons of simplification. Through the reflectors 13*a*, 13*b* which are arranged spaced relatively far from the light source 14 it is ensured that the illuminated site 11 of the operation is formed by light rays from different directions convergent to the axis 20.

In accordance with FIG. 1 the used light beam 16 which emerges from the light source 14 is downwardly reflected at the main reflector 13 so that a main light beam 12 is obtained which essentially conically converges from the top downwardly and has a diameter at the site of the operation such that the entire area into which the surgeon needs to look is uniformly illuminated.

It can now transpire that a relatively narrow and deep recess 21 is present at the site of the operation 11, for example a narrow and deep wound, so that the individual light rays of the strongly convergent main light beam 12 for example no longer reach a central region 22 in the area of the base of the wound 21.

In order to be able to also fully illuminate this region which may be particularly important for the operation an auxiliary reflector 15 is provided in accordance with the invention within the circular ring-shaped main reflector 13 concentric to the light source 14 and to the axis 20. In the simplest case this auxiliary reflector comprises two diametrically oppositely disposed concave mirror auxiliary regions 15*a*, 15*b* which however, in just the same way as the main regions 13*a*, 13*b*, are expediently combined into a unitary circular ring. The outer diameter of the concave mirror-like auxiliary reflector 15 corresponds approximately to the inner diameter of the main reflector 13. The auxiliary reflector 15 has nuts 17 with vertical threaded bores secured to it at its periphery. Threaded bars 18, which are in turn rotatably but axially non-displaceably secured to the main reflector 13, or to a frame supporting it, pass through the nuts.

Whereas the auxiliary reflector 15 is located in the inactive position of FIG. 1, with its upper edge directly beneath the used light beam 16, it can be displaced upwardly coaxial to the main reflector 13 by rotation of the threaded bars 18 into the position which can be seen from FIG. 2 in which is located in the lower part, and indeed preferably in the lower half of the operational light beam 16. In this way the lower regions of the operational light beam are prevented from reaching the lower part of the main reflector 13. In place of this this part of the operational light beam is reflected at a substantially smaller distance from the light source 14 or from the axis 20 downwardly in the direction of the site 11 of the operation and is simultaneously concentrated in the manner required for the desired illumination.

As the auxiliary reflector 15 is located closer to the main beam axis 20 than the main reflector 13 an inner auxiliary light beam 19 is directed from it towards the site 11 of the operation and is formed as a downwardly conically tapering light beam, analogous to the main light beam 12, but has a substantially smaller cone angle than the main light beam 12. In other words the rays of the auxiliary light beam 19 fall at a steeper angle onto the site 11 of the operation and can thus penetrate deeper into the wound 21, so that the central region 22 within the wound 21 is still fully illuminated.

Through the inventive arrangement and displacement of the auxiliary reflector 15 the outer region of the main light beam 12 is thus practically folded inwardly, with the turning point being located in the region of the center of the site 11 of the operation. Thus the measures of the invention essentially change the average convergence of the light beam which is incident at the site 11 of the operation, so that the surgeon can match the lighting to various surgical problems.

The reflector surfaces of the reflectors 13, 15 can, in accordance with the invention, be formed by abutting individual ring surfaces of a curvature such that each of these individual ring surfaces illuminates the entire site of the operation. The reflectors expediently have a common focal point.

In a preferred arrangement only one common light source is used for several reflectors. It would however also be conceivable to provide a separate light source for the auxiliary reflector 15 in the position of FIG. 1, with this light source then lying beneath the main light source 15 and being selectively switched on.

The common light source can preferably be a halogen lamp or a gas discharge lamp.

The surgeon and his auxiliary personal can be protected from being dazzled by a suitable arranged antidazzle-ring.

The light yield of the operating theatre lamp can be increased by a suitable arranged counter reflector.

Insofar as the auxiliary or deep light reflector 15 is partially transmitting, in accordance with a further embodiment, the light can be proportionally deflected via the lower part of the outer main reflector 13 and via the auxiliary reflector to the site of the operation 11. In this way the angular width of the convergence of the incident light is considerably increased.

The double arrow in FIG. 2 also indicates that the size of the site of the operation 11 can be made variable by displacement of the light source 14 and that the spacing can be made focussable.

Although it is basically possible in accordance with the invention to interleave more than two reflectors, the arrangement of only two interleaved reflectors (main and auxiliary reflector) is to be preferred because in this way a particularly simple mechanical construction is obtained and the actuation is also simple.

The signal for the adjustment of the auxiliary reflector 15 can optionally be generated automatically by an ultrasonic sensor.

Furthermore, it is possible to suggest to the surgeon the need for an adjustment of the auxiliary reflector by a measuring system.

The reference numeral 23 designates a lower transparent lamp cover.

I claim:

1. An operating theater lamp comprising:

a light source;

a main reflector including at least two diametrically opposed concave mirror regions positioned to reflect the light from the light source and converge it onto a site to be illuminated;

an auxiliary reflector comprising at least two diametrically opposed auxiliary mirror regions disposed between said light source and said main reflector, said auxiliary mirror regions being movable relative to the main reflector between an inoperative position in which said auxiliary mirror regions are displaced completely outside of the light path from the light source, and an operative position in which said auxiliary mirror regions are located relative to the light source to reflect a portion of the light and concentrate it on the site at a greater angle than the angle at which a remaining portion of light reflected from said main reflector converges on the site.

2. An operating theater lamp according to claim 1 wherein at least one of said concave mirror regions of said main reflector and said auxiliary reflector is a segment of a circle coaxial with the light source.

3. An operating theater lamp according to claim 2 wherein said concave mirror regions are concentric with one another and with the light source.

4. An operating theater lamp according to claim 3 wherein said concave mirror regions of said main reflector are joined to form a single, uniform semi-circular ring.

5. An operating theater lamp according to claim 3 wherein said concave mirror regions of said main reflector are joined to form a single, uniform polygonal ring.

6. An operating theater lamp according to claim 3 wherein said concave mirror regions of said auxiliary reflector are joined to form a single, uniform semi-circular ring.

7. An operating theater lamp according to claim 3 wherein said concave mirror regions of said auxiliary reflector are joined to form a single, uniform polygonal ring.

8. An operating theater lamp according to claim 1 including means for moving said auxiliary reflector relative to the main reflector to any position between the light path from the light source and said main reflector.

9. An operating theater lamp according to claim 8 including a threaded nut connected to the auxiliary reflector and a threaded bar engaging said nut and being rotatable about a vertical axis such that said auxiliary reflector can be displaced axially relative to the main reflector by rotating said bar.

10. An operating theater lamp according to claim 1 wherein the auxiliary reflector is partially light transmissive.

11. An operating theater lamp according to claim 1 wherein the central light source is movable relative to the main reflector.

12. An operating theater lamp according to claim 1 wherein the mirror regions of the main reflector comprise abutting, individual, concentric ring surfaces having a curvature such that the light from the light source can be reflected in a predetermined direction to illuminate the site.

13. An operating theater lamp according to claim 1 wherein the mirror regions of the auxiliary reflector comprise abutting individual, concentric ring surfaces having a curvature such that the light from the light source can be reflected in a predetermined direction to illuminate the site.

* * * * *